US006512834B1

(12) United States Patent
Banter et al.

(10) Patent No.: US 6,512,834 B1
(45) Date of Patent: Jan. 28, 2003

(54) ACOUSTIC PROTECTIVE COVER ASSEMBLY

(75) Inventors: Chad Anthony Banter, Bear, DE (US); Brian G. Chapman, Elkton, MD (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

(21) Appl. No.: 09/348,416

(22) Filed: Jul. 7, 1999

(51) Int. Cl.[7] ..... H04R 25/00
(52) U.S. Cl. ..... 381/386; 381/189
(58) Field of Search ..... 379/439, 452; 181/175; 381/386, 189, FOR 151, FOR 140, FOR 165

(56) References Cited

U.S. PATENT DOCUMENTS

| | | | | |
|---|---|---|---|---|
| 3,953,566 A | | 4/1976 | Gore | 264/288 |
| 4,071,040 A | | 1/1978 | Moriarty | 137/199 |
| 4,110,392 A | | 8/1978 | Yamazaki | 264/127 |
| 4,187,390 A | | 2/1980 | Gore | 174/102 R |
| 4,949,386 A | | 8/1990 | Hill | 381/188 |
| 4,987,597 A | | 1/1991 | Haerti | 381/69 |
| 5,116,650 A | | 5/1992 | Bowser | 428/34.2 |
| 5,286,279 A | | 2/1994 | Wu | 95/45 |
| 5,342,434 A | | 8/1994 | Wu | 96/13 |
| 5,376,441 A | | 12/1994 | Wu et al. | 428/304.4 |
| 5,385,694 A | | 1/1995 | Wu et al. | 252/312 |
| 5,420,570 A | | 5/1995 | Leitten et al. | 340/574 |
| 5,460,872 A | | 10/1995 | Wu et al. | 428/304.4 |
| 5,462,586 A | | 10/1995 | Sugiyama et al. | 96/13 |
| 5,828,012 A | * | 10/1998 | Repolleet et al. | 181/175 |

FOREIGN PATENT DOCUMENTS

| | | | |
|---|---|---|---|
| GB | 2064265 A | * | 6/1981 |
| JP | 10-165787 | | 6/1998 |

* cited by examiner

*Primary Examiner*—Curtis Kuntz
*Assistant Examiner*—P. Dabney
(74) *Attorney, Agent, or Firm*—Carol A. Lewis White

(57) ABSTRACT

A sound-transmissive cover assembly is disclosed which provides protection from the ambient environment to transducer devices, such as microphones, loudspeakers, buzzers, ringers and the like. The cover assembly has a microporous protective membrane that is captivated at the outer region near the edges between two adhesive support systems. An inner unbonded region surrounded by the bonded outer region is provided so that the protective membrane can displace or move in response to acoustic pressure waves. The protective membrane design in conjuction with the configuration allows sound energy to pass through the protective membrane with very low attenuation, while being able to withstand long-term exposure to liquid intrusion. An embodiment of the cover assembly includes an attached acoustic gasket so as to seal and focus acoustic energy to housing apertures or openings.

16 Claims, 3 Drawing Sheets

ACOUSTIC PROTECTIVE COVER ASSEMBLY

FIELD OF THE INVENTION

The present invention generally relates to an acoustic protective cover for a transducer (such as a microphone, ringer or speaker) employed in an electronic device. More specifically, the present invention relates to an acoustic protective cover assembly including a microporous protective membrane that provides both low acoustic loss and the ability to withstand long-term exposure to liquid intrusion.

BACKGROUND OF THE INVENTION

Most modern electronic devices, such as radios and cellular telephones, include transducers, e.g., microphones, ringers, speakers, buzzers and the like. These electronic devices often comprise housings having small apertures or holes located over the transducers to enable the transducers to transmit or receive sound signals from within the housing. However, although this configuration protects against incidental exposure to water (e.g., a raindrop), it excessively attenuates a transducer's effectiveness and sound quality. Furthermore, it cannot resist the entry of a significant amount of water. Accordingly, acoustic protective covers have been utilized between the transducers and the housing to protect the transducers from damage due to the entry of water or other liquids.

Prior art acoustic protective covers are typically composed of a porous, fabric material constructed solely on reducing the material's resistance to air flow of which larger effective pore size resulting in thicker materials has been the means for achieving the high air flow parameters. Here, the amount of sound attenuation of the material is inversely proportional to the size of its pores, i.e., sound attenuation decreases as pore size increases. However, the size of the pores oppositely affects the water resistance of the material. Materials having extremely small or no pores are highly water resistant.

Thus, prior art acoustic protective covers have focused on having either large pores for enhanced sound transmission and quality, or extremely small pores and tighter structure for high water resistance. A focus on the former results in an acoustic protective cover that at best provides an electronic device minimal protection against exposure to water. A focus on the latter protects the electronic device from larger amounts of water, but results in poor sound quality due to high sound attenuation. Even the treatment of the porous materials for water repellency fails to permit immersion of the electronic device to significant depths because of the large pore structure.

A general description of prior art patents adhering to the above-described scientific principle follows.

U.S. Pat. No. 4,949,386, entitled "Speaker System," teaches an environmental protective covering system, comprising in part a laminated two-layer construction defined by a polyester woven or non-woven material and a microporous polytetrafluoroethylene ("PTFE") membrane. The hydrophobic property of the microporous PTFE membrane prevents liquid from passing through the environmental barrier system. However, although this laminated covering system may be effective in preventing liquid entry into an electronic device, the lamination causes excessive sound attenuation which is unacceptable in modern communication electronics where excellent sound quality is required. Furthermore, while it is effective at preventing instantaneous liquid entry, long-term liquid exposure is limited because of eventual breakdown of the adhesive/membrane interface.

U.S. Pat. No. 4,987,597, entitled "Apparatus For Closing Openings Of A Hearing Aid Or An Ear Adaptor For Hearing Aids," teaches the use of a microporous PTFE membrane as a covering for an electronic transducer. The membrane restricts liquid passage through the membrane without significantly attenuating sound signals. However, the patent fails to specifically teach which material parameters of the membrane are required in order to achieve both low sound loss and long-term exposure to liquid entry, although it does generally describe the parameters in terms of porosity and air permeability.

U.S. Pat. No. 5,420,570, entitled "Manually Actuable Wrist Alarm Having A High-Intensity Sonic Alarm Signal," teaches the use of a non-porous film as a protective layer to protect an electronic device from liquid entry. As previously discussed, although a non-porous film can provide excellent liquid entry resistance, such non-porous films suffer from relatively high sound transmission losses which excessively distort sound signals. The increase in transmission loss results from the relatively high mass associated with non-porous films.

U.S. Pat. No. 4,071,040, entitled "Water-Proof Air Pressure Equalizing Valve," teaches the disposition of a thin microporous membrane between two sintered stainless steel disks. Although such a construction may have been effective for its intended use in rugged military-type field telephone sets, it is not desirable for use in modern communication electronic devices because the sintered metal disks are relatively thick and heavy. Furthermore, disposing a microporous membrane between two stainless steel disks physically constrains the membrane, thereby limiting its ability to vibrate, which reduces sound quality by attenuating and distorting a sound signal being transmitted.

To overcome some of the shortcomings described above with respect to the '386, '597, '570 and '040 patents, U.S. Pat. No. 5,828,012, entitled "Protective Cover Assembly Having Enhanced Acoustical Characteristics," teaches a sound-transmissive acoustic cover assembly that has a protective membrane that is bonded to a porous support layer so that an inner unbonded region surrounded by an outer bonded region is formed. In this configuration, the membrane layer and the support layer are free to independently vibrate or move in response to acoustic energy passing therethrough, thereby minimally attenuating the acoustic energy. However, although the cover assembly reduces the acoustic attenuation, the degree of acoustic attenuation is limited because of the increase in material mass and thickness by which the acoustic energy has to pass (i.e., acoustic energy has to first pass through the membrane, and then additionally pass through the support layer).

Finally, Japanese Laid Open Patent Application No. 10-165787, entitled "Porous Polytetrafluoroethylene Film And Manufacturing Process For Same," teaches the use of a porous PTFE film to protect an electronic device from liquid entry while maintaining sound permeability. A longitudinally-stretched PTFE membrane is coated on one or both sides with a thermoplastic resin netting that functions as both a reinforcing material and a shape stabilizing material. Using this manufacturing method, the size of the pores in the film uniformly expand to improve sound permeability by means of the thinning of the membrane without compromising the film's water resistance. Such a porous PTFE film exhibits sound attenuation of no more than 1 dB for frequencies of 300–3000 Hz (i.e., the range of frequencies known as the "telephony range") and static water pressure resistance of 30 cm or above. However, although the PTFE film covering effects relatively low sound attenuation, overall sound transmission loss is excessive and is considered unacceptable in modern communication electronic devices. Additionally, the PTFE film lacks the ability to withstand long-term water intrusion at higher pressures.

Because the sole focus of the above-described prior art patents is on membrane porosity, the higher airflow membranes taught therein can produce low sound transmission loss but are unable to meet IP-57 level water protection as defined by the International Electrotechnical Commission ("IEC") (1 meter water submersion for 30 minutes). The IEC is affiliated with the International Organization for Standardization ("ISO"), and publishes the IP Code, entitled "Degrees Of Protection Provided By Enclosures," to describe a system for classifying the degrees of protection provided by enclosures for electrical equipment. One of the enumerated objects of the standard is to protect the equipment inside an enclosure against harmful effects due to the ingress of water. The IP-57 standard is described in IEC publication Reference No. 529, Second Impression, 1992.

Because the consumer market desires to use electronic devices in demanding environmental and working conditions such as exposure to long-term liquid and particle intrusion, the demand for durable, water-resistant electronic devices having a high sound quality has increased remarkably. Therefore, there exists a need for an acoustic protective cover having high airflow to allow for low sound attenuation (i.e., less than 3 dB) while providing IP-57 level protection. The acoustic protective cover should also be lightweight and sufficiently rigid for quick and accurate installation.

In addition to the foregoing, an acoustic gasket is desirable to eliminate flanking paths, structural vibrations and focus acoustic energy to the housing apertures. More particularly, if no acoustic gasket is utilized between sound transducers (loudspeakers, ringers, microphones, etc.) and the housing, acoustic energy may leak into other regions of the housing, thereby attenuating and distorting the sound energy entering or leaving the housing. Such sound energy leakage can result in attenuation and distortion of sound projected out of the housing by transducers such as loudspeakers, ringers, etc., or of sound entering the housing to actuate a microphone. Without acoustic gaskets, these acoustic losses result in reduced battery life of communication electronic devices and higher transducer output levels. Acoustic gaskets can improve the effectiveness of loudspeakers by isolating them from the housing, thereby converting more of the speaker's mechanical energy directly into acoustic energy. Acoustic gaskets and materials are well-known in the art, however, they are usually assembled into devices as separate components and thereby increase the cost and complexity of manufacturing the devices.

The foregoing illustrates limitations known to exist in present acoustic protective covers and gasket systems for electronic communication devices. Thus, it is apparent that it would be advantageous to provide an improved protective system directed to overcoming one or more of the limitations set forth above. Accordingly, a suitable alternative is provided including features more fully disclosed hereinafter.

SUMMARY OF THE INVENTION

In connection with the foregoing, a sound-transmissive acoustic protective cover assembly is disclosed that protects electronic devices from long-term exposure to liquid intrusion while providing equivalent or better sound attenuation than pre-existing acoustic covers. The assembly includes a microporous protective membrane that meets IP-57 requirements with low sound loss by recognizing that the important parameters on which to focus when constructing the membrane are moving mass and thickness, not air flow. A reduction in both the moving mass and thickness of the membrane effectively reduces sound transmission loss within the telephony range.

According to one embodiment of the invention, the assembly comprises a microporous protective membrane that is captivated between two adhesive support systems. The first adhesive support system can be either a single- or double-sided adhesive, however the primary function of this adhesive support system is to anchor the membrane to the opposing adhesive support system. The second adhesive support system is a double-sided adhesive that serves as a gasket for the transducer or the housing, depending on the application. Both adhesive support systems are bonded to the membrane so that an inner unbonded region surrounded by an outer bonded region is formed on the membrane. In the unbonded region, the combination of the two adhesive support systems allows upstream sound pressure waves to vibrate the membrane and transfer the structureborne energy (mechanical vibration) of the membrane to airborne energy (pressure waves) downstream of the acoustic protective cover assembly, resulting in low acoustic loss/attenuation. In addition to minimizing transmission loss, the acoustic cover assembly provides IP-57 level water protection for the membrane discussed above. This level of water protection can be achieved because of the additional stiffness and anchoring provided to the membrane. The opposing adhesive support system prevents the assembly from structural failure caused by the membrane peeling away from the adhesive.

According to another embodiment of the present invention, the first adhesive support system is a double-sided adhesive that further incorporates a gasket to direct sound through the openings in the housing of the electronic device to account for gaps between the acoustic protective cover assembly and the device ports that can cause acoustic leakage and thereby increase the transmission loss of the device.

According to another embodiment of the invention, the protective membrane is bonded only to the second adhesive support system.

According to yet another embodiment of the invention, the protective membrane is injection-molded into a cap.

The apparatus and method of the invention will be more readily understood and apparent from the following detailed description of the invention when read in conjunction with the accompanying drawings, and from the claims which are appended at the end of the detailed description.

DETAILED DESCRIPTION OF THE INVENTION

Figure 2:
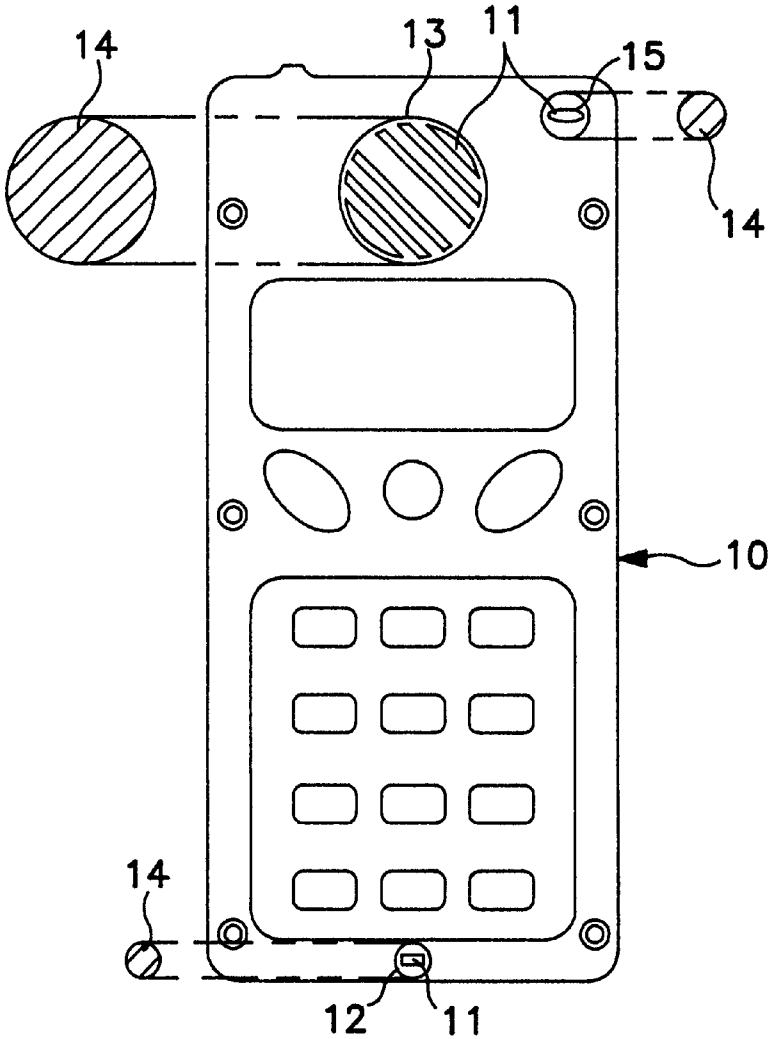
FIG. 2 is an internal view of the cellular phone front housing cover of FIG. 1.

Referring now to the drawings, wherein similar reference characters designate corresponding parts throughout the several views, embodiments of the sound-transmissive acoustic protective cover assembly and gasket system of the present invention are generally shown in a variety of configurations and dimensioned for use to cover a transducer in a typical electronic device, such as a cellular phone. As should be understood, the present invention is not limited to the embodiments illustrated herein, as they are merely illustrative and can be modified or adapted without departing from the scope of the appended claims.

As the term is used herein, "captive construction" refers to the bonding of a protective membrane between two adhesive support systems.

As the term is used herein, "microporous membrane" means a continuous sheet of material that is at least 50% porous (i.e., having a pore volume $\leqq 50\%$) with 50% or more of the pores being no more than about 5 $\mu$m in nominal diameter.

As the term is used herein, "oleophobicity" generally refers to the property of a material to repel or not absorb oils while allowing the passage of gases.

As the term is used herein, "hydrophobicity" generally refers to the property of a material to repel or not absorb water while allowing the passage of gases.

As the term is used herein, "acoustic gasket" and derivations thereof shall mean a material having properties of absorbing or reflecting sound wave energy when compressed between two surfaces to form a seal. The acoustic gasket can be used in a conventional manner between a transducer and a housing surface, or between surfaces within a housing, to acoustically isolate and dampen vibrations in selected areas.

Figure 1:
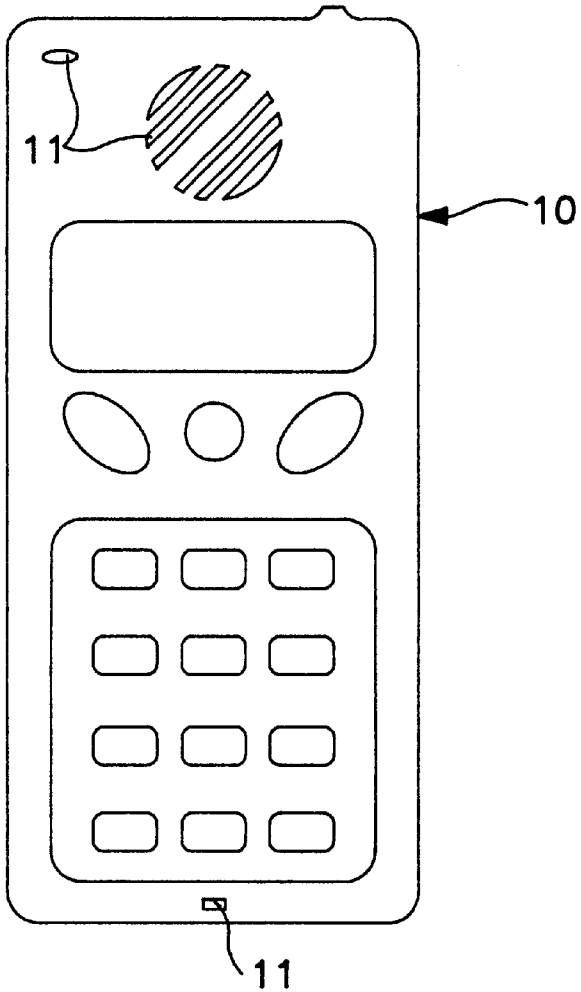
FIG. 1 is an external view of a conventional cellular phone front housing cover employing an acoustic protective cover assembly.

FIG. 1 is an external view of a conventional cellular phone front housing cover 10 having small openings or apertures 11. The number, size and shape of the apertures may vary greatly. Alternate aperture designs include narrow slots or a variable number of circular apertures.

FIG. 2 is an internal view of the front housing cover 10 illustrating a microphone mounting location 12, a speaker mounting location 13 and an alert mounting location 15. In addition, FIG. 2 illustrates generally a typical mounting location for acoustic protective cover assemblies 14 which are mounted in the microphone mounting location 12, the speaker mounting location 13 and the alert location 15.

Figure 3:
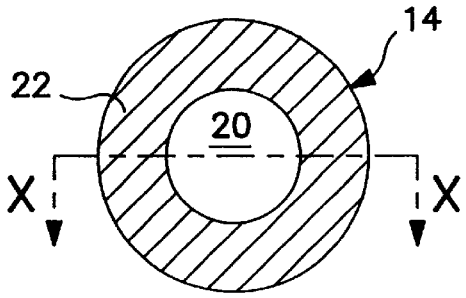
FIG. 3 is a top view of an embodiment of a "captive construction" acoustic protective cover assembly of the present invention.
Figure 4:
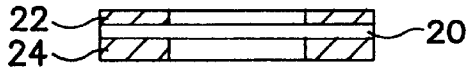
FIG. 4 is a sectional view of the acoustic protective cover assembly of FIG. 3 taken along line X—X.

FIGS. 3 and 4 illustrates an acoustically transparent "captive construction" embodiment of a protective cover assembly 14 of the present invention. As previously described, "captive construction" describes the configuration of the protective cover assembly 14, where a microporous protective membrane 20 is generally held "captive" between a first adhesive support system 22 and a second adhesive support system 24.

The adhesive support systems 22 and 24 are bonded so that an inner unbonded region of the protective membrane 20 exposed to the atmosphere surrounded by an outer bonded region is formed. In the unbonded region, the combination of the two adhesive support systems 22 and 24 constrains the edge of the protective membrane 20 and thus allows upstream sound pressure waves to vibrate the protective membrane 20 and transfer structureborne energy (mechanical vibration) of the protective membrane 20 to airborne energy (pressure waves) downstream of the acoustic protective cover assembly 14, resulting in low acoustic loss/attenuation.

The protective membrane 20 serves to provide a barrier to dust and other particulates, is resistant to penetration by water or other aqueous fluids, and, in order to minimize sound loss therethrough, is porous. The protective membrane 20 is preferably microporous which, among other things, reduces the membrane weight compared to nonporous materials. The protective membrane 20 can be made of any one of many polymeric materials, including but not limited to, e.g., polyamide, polyester, polyolefins such as polyethylene and polypropylene, or fluoropolymers. Fluoropolymers such as polyvinylidene fluoride ("PVDF"), tetrafluoroethylene-hexafluoropropylene copolymer ("FEP"), tetrafluoroethylene-(perfluoroalkyl) vinyl ether copolymer ("PFA"), polytetrafluoroethylene ("PTFE") and the like, are preferred for their inherent hydrophobicity, chemical inertness, temperature resistance, and processing characteristics. Porous protective membranes, if not made of inherently hydrophobic materials, can have hydrophobic properties imparted to them, without significant loss of porosity, by treatment with fluorine-containing water-and oil-repellent materials known in the art. For example, the water- and oil-repellent materials and methods disclosed in U.S. Pat. Nos. 5,116,650, 5,286,279, 5,342,434, 5,376,441 and other patents, can be used.

The protective membrane 20 should also preferably be treated with an oleophobic treatment to improve their resistance to leakage with low surface tension liquids. The treatments typically are coatings of fluorinated polymers such as, but not limited to, dioxole/TFE copolymers, such as those taught in U.S. Pat. Nos. 5,385,694 and 5,460,872, perfluoroalkyl acrylates and perfluoroalkyl methacrylates such as those taught in U.S. Pat. No. 5,462,586, fluoro olefins and fluorosilicones. A particularly preferred liquid impermeable, gas permeable membrane is a microporous membrane of expanded PTFE ("ePTFE") treated with dioxole/TFE copolymers and perfluoroalkyl acrylate polymers.

The protective membrane 20 should have the following properties: thickness in the range of about 3 to 150 micrometers, preferably in the range 3 to 33 micrometers; nominal pore size in the range of 0.05 to 5 micrometers, preferably in the range of about 0.05 to 1 micrometers; pore volume in the range of 20 to 99 percent, preferably in the range of 50 to 95 percent; air permeability in the range of 0.15 to 50 Gurley-seconds, preferably in the range of 1 to 10 Gurley-seconds; water entry pressure resistance in the range of 5 to 200 psi, preferably in the range 20 to 150 psi; mass in the range of about 1 to 40 grams/$m^2$, preferably in the range of 1 to 30 grams/$m^2$; and long-term water entry pressure duration of greater than 0.5 hours at 1 meter of water pressure, preferably greater than 4 hours at 1 meter of water pressure.

In one embodiment of the present invention, the protective membrane 20 is comprised at least in part of microporous PTFE. The microporous PTFE may be prepared by any of a number of known processes, for example, by stretching or drawing processes, by paper-making processes, by processes in which filler materials are incorporated with the PTFE resin and which are subsequently removed to leave a porous structure, or by powder sintering processes. Preferably, the microporous PTFE material is microporous ePTFE having a microstructure of interconnected nodes and fibrils, as described in U.S. Pat. Nos. 3,953,566; 4,187,390; and 4,110,392, which are incorporated herein by reference, and which fully describe the preferred material and processes for making them. The microporous PTFE material can contain pigments, such as a carbon black, or dyes by which it is colored for aesthetic purposes.

The adhesive support systems 22 and 24 are preferably configured in system forms generally consisting of a substrate with an adhesive, such as pressure-sensitive tape. Examples of suitable substrates include web and mesh materials. The adhesive can be thermoplastic, thermosetting, or reaction curing types, in liquid or solid form, selected from the classes including, but not limited to, acrylics, polyamides, polyacrylamides, polyesters, polyolefins, polyurethanes, polysilicons and the like. The adhesive support systems 22 and 24 can also be adhesives without substrates, which can be applied directly to the membrane 20 by screen printing, gravure printing, spray coating, powder coating, and the like.

The protective membrane 20 and adhesive support systems 22 and 24 are generally superposed and positioned so that their edges are coextensive, although such need not always be the case. The protective membrane 20 and adhesive support systems 22 and 24 are bonded together at least in the peripheral regions near their edges, so as to form and surround one or more inner unbonded region(s) within the outer bonded region. For acoustic cover assemblies 14 in which the span defined by the inner perimeter of the bonded region is about 38 millimeters (1½ inches) or less, there is generally no need for additional bonding of the adhesive support systems 22 and 24 to the protective membrane 20. In cases where the span is greater than about 38 millimeters it may be desirable to provide additional bond sites at discrete widely separated points. The purpose is two-fold. The first is to reduce the acoustic distortion across the assembly 14 by allowing upstream sound pressure waves to vibrate the membrane 20 and transfer the structureborne energy (mechanical vibration) of the membrane 20 to airborne energy (pressure waves) downstream of the acoustic protective cover assembly 14. The second is to reduce membrane point loads associated with large areas exposed to high liquid pressures. For very large acoustic protective cover assemblies 14 it may be more convenient to use widely separated bond lines instead of discrete bond points. The need for additional bonding of the layers of the acoustic protective cover assembly 14 is dependent on the shape of the area or device to be covered as well as by the size of the assembly 14. Thus, some experimentation may be needed to establish the best method and pattern of additional bonding to optimize acoustic performance of the cover assembly 14. In general, for all sizes, it is preferred that the area of the bonded region(s) be minimized, to the extent permitted by the mechanical and acoustic requirements of the assembly 14, and the area of the open unbonded region(s) be maximized.

The purpose of the first and second adhesive support systems 22 and 24 is to provide mechanical support to the protective membrane 20 in the event of unexpected forces applied against the protective membrane 20. For example, against hydrostatic pressure forces on the acoustic protective cover assembly 14 when the device in which the assembly 14 is mounted or immersed in water, as might occur, for example, if a cellular telephone is dropped into a swimming pool, or overboard from a boat. The captive construction provides the further benefit of making it possible to use thinner, and possibly weaker, protective membranes 20 which improves sound transmission through the acoustic protective cover assembly 14. The captive construction in combination with the two adhesive support systems 22 and 24, complete a stiff acoustic protective cover assembly 14 which is much more easily handled in manufacturing and assembly processes than are the components separately. As noted earlier, the prior art suggests a laminated construction to satisfy these needs; however, such a construction excessively attenuates and distorts sound energy passing therethrough because the lamination adds mass. Additionally, captive construction allows for a thicker, more robust assembly 14 within an electronic device that requires aggressive environmental conditions without significantly compromising acoustic performance.

Furthermore, captive construction permits sound energy to pass through the acoustic protective cover assembly 14 with minimal attenuation whilst still obtaining support and handling benefits. The protective membrane 20 and adhesive support systems 22 and 24 are bonded together only in selected areas or regions, so that large unbonded areas between the adhesive support systems 22 and 24 are provided. Thus, the protective membrane 20, constrained by the adhesive support systems 22 and 24, is free to move or vibrate in the unbonded region in response to acoustic energy.

Figure 5:
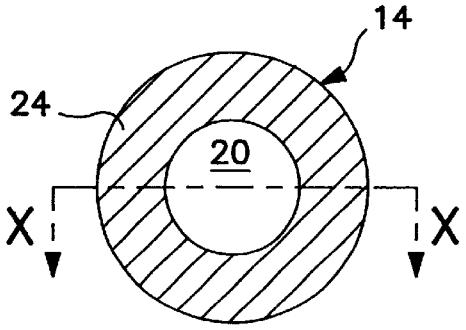
FIG. 5 is a bottom view of an embodiment of an acoustic protective cover assembly having a single adhesive support system.
Figure 6:
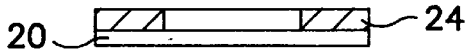
FIG. 6 is a sectional view of the acoustic protective cover assembly of FIG. 5 taken along line X—X.

Referring now to FIGS. 5 and 6, an alternate construction of the acoustic protective cover assembly 14 is shown. This embodiment is identical to the captive construction embodiment described above in all aspects except that it does not have a first adhesive support system 22. In other words, the protective membrane 20 is completely unbonded on one of its sides and is thus more vulnerable to peeling away from the adhesive support system 24 .Thus, for this configuration, the adhesive of the adhesive support system 24 must be extremely strong. Some experimentation may be required to find an adhesive that adequately bonds to the protective membrane 20 and prevents the membrane 20 from peeling away from the adhesive support system 24 .

Figure 7:
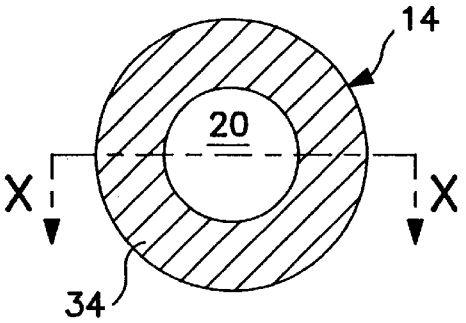
FIG. 7 is a top view of an embodiment of an acoustic protective cover assembly having a gasket attached thereto.
Figure 8:
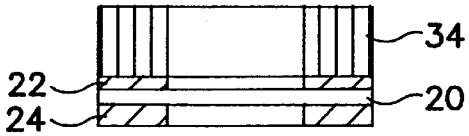
FIG. 8 is a sectional view of the acoustic protective cover assembly of FIG. 7 taken along line X—X.

FIGS. 7 and 8 illustrate an embodiment of the "captive construction" acoustic protective cover assembly 14 as shown in FIGS. 3 and 4, wherein an acoustic gasket 34 is bonded to the first adhesive support system 22. In this embodiment, the first adhesive support system 22 is a double-sided adhesive. The acoustic gasket 34 is attached so as to permit independent movement of the protective membrane 20 in the unbonded region.

Conventional commercially-available materials are known in the art and are suitable for use as the acoustic gasket material. For example, soft elastomeric materials or foamed elastomers, such as silicone rubber and silicone rubber foams, can be used. A preferred gasket material is a microporous PTFE material, and more preferably, a microporous ePTFE having a microstructure of interconnected nodes and fibrils, as described in U.S. Pat. Nos. 3,953,566; 4,187,390; and 4,110,392; which are incorporated herein by reference. Most preferably, the acoustic gasket material comprises a matrix of microporous ePTFE which may be partially filled with elastomeric materials. The acoustic gasket 34 can be bonded to the cover materials using the methods and materials for bonding together the protective membrane 20 and adhesive support systems 22 and 24.

Figure 9:
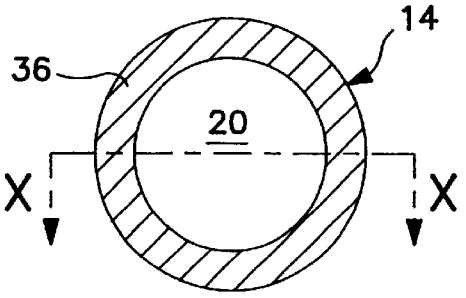
FIG. 9 is a top view of an embodiment of an acoustic protective cover assembly having a protective membrane injection-molded into a cap.
Figure 10:
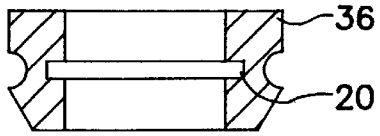
FIG. 10 is a sectional view of the acoustic protective cover assembly of FIG. 9 taken along line X—X.

FIGS. 9 and 10 illustrate an embodiment of the acoustic protective cover assembly 14 where the protective membrane 20 is injection-molded to a plastic encapsulation or cap 36. Vulcanizable plastics, such as silicones or natural rubber, and thermoplastics, such as polypropylene, polyethylene, polycarbonates or polyamides, as well as preferably thermoplastic elastomers, like Santoprene® or Hytrel®, are particularly suitable as material for the plastic encapsulation 36. All these plastics can be used in the so-called insert molding injection-molding process, which offers the significant advantage that injection-molding of the plastic encapsulation 36 to the microporous membrane 20 is possible in one work process. In particular, the thermoplastic elastomers combine the properties of being able to be processed in the insert molding injection-molding process and preserving their elastomer properties in so doing.

Although the protective membrane 20 is illustrated as being molded in the middle of the cap 36, it should be understood that the membrane 20 can be molded into a groove formulated in any vertical position on the cap 36, e.g., on the top or bottom.

The cover assembly 14 can be used to protect a transducer located in a rigid enclosure or housing such as a cellular telephone, portable radio, pager, loudspeaker enclosure and the like. The assembly 14 must be therefore designed with consideration of the dimensional characteristics and acoustic properties of the transducer first and secondly with respect to the sound transmission apertures of the housing. This is particularly important in sizing the unbonded area of the assembly 14. Although no precise relationship is required, it is preferable that the unbonded area be much larger than the area of the apertures in the housing near which the cover assembly 14.

Figure 11:
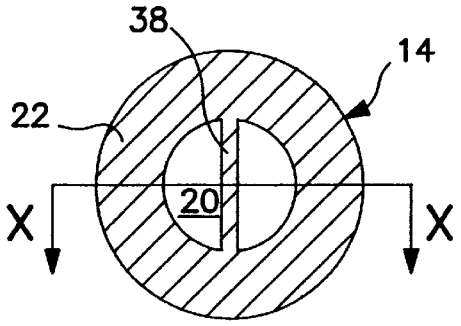
FIG. 11 is a top view of an embodiment of an acoustic protective cover assembly having a protective membrane with a supplemental bonding site designed for center support.
Figure 12:
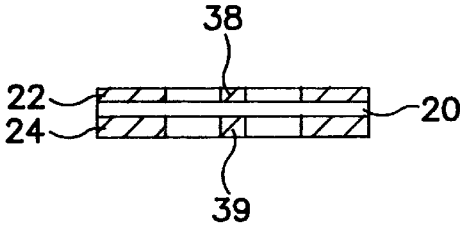
FIG. 12 is a sectional view of the acoustic protective cover assembly of FIG. 11 taken along line X—X.

FIGS. 11 and 12 illustrate further "captive construction" embodiments as described above in all aspects except that a supplemental bonding site 38, 39 within the adhesive support system 22 and 24 spans across the protective membrane 20. The supplemental bonding site 38, 39 provides support for a cover assembly with a relatively large inner unbonded region, as discussed above.

Figure 13:
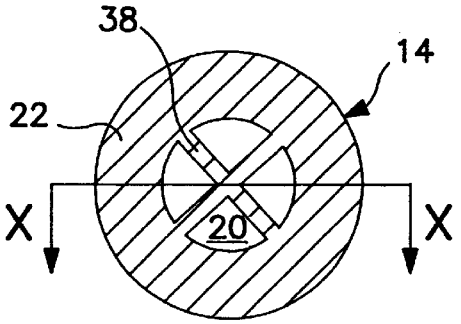
FIG. 13 is a top view of an embodiment of an acoustic protective cover assembly having a protective membrane with an alternative supplemental bonding site designed to improve bonding support.
Figure 14:
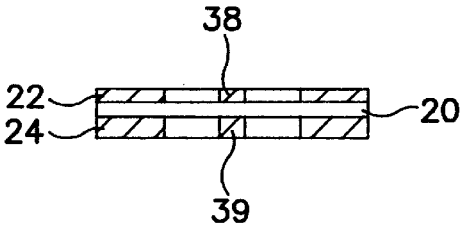
FIG. 14 is a sectional view of the acoustic protective cover assembly of FIG. 13 taken along line X—X.

FIGS. 13 and 14 illustrate even further "captive construction" embodiments similar to that shown in FIG. 11 and 12 in all aspects except that an alternative geometry of supplemental bonding site 38, 39 within the adhesive support system 22 and 24, spans across the protective membrane 20.

Test Methods (1) Acoustic Transmission Loss

Samples were tested and evaluated using a combination of the analysis procedures and methodology as delineated in: ASTM E 1050-90, (Standard Test Method for Impedance and Absorption of Acoustical Materials); ASTM C 384, (Test Method for Impedance and Absorption of Acoustical Materials by the Impedance Tube Method); Leo L. Beranek, (Acoustics); A. F. Seybert, (Two-sensor methods for the measurement of sound intensity and acoustic properties in ducts).

Figure 15:
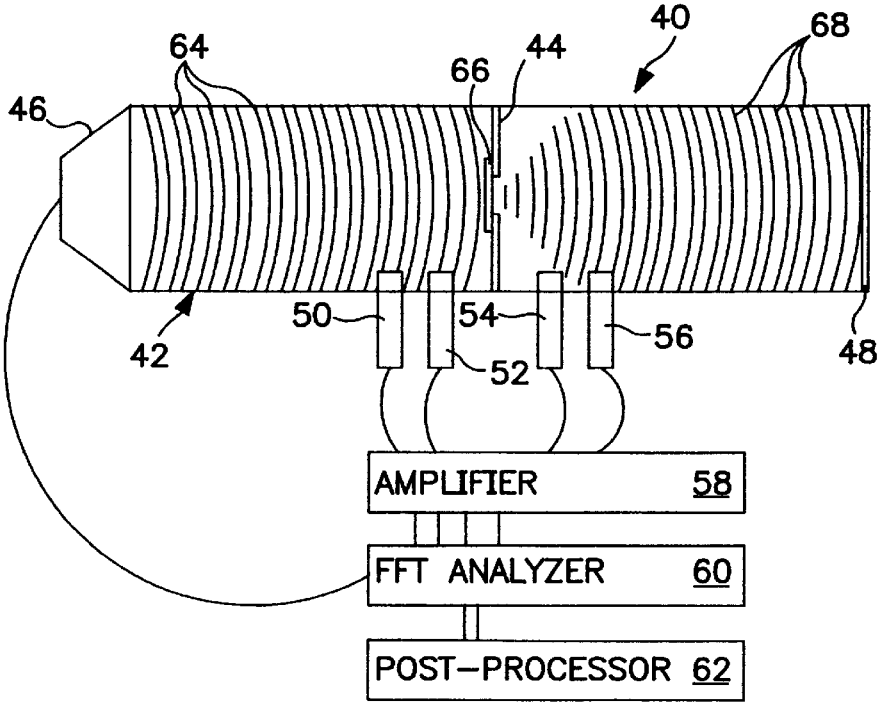
FIG. 15 is a perspective view of an apparatus used to measure acoustic transmission loss.

An apparatus 40 used to test a sample is shown in FIG. 15. The apparatus generally comprises an impedance measuring tube 42 housing a fixture plate 44 with a speaker 46 and a semi-anechoic termination 48 at opposing ends of the tube 42. The fixture plate 44 has an open area of 16 millimeters in diameter. A first pair of microphones 50 and 52 lie on the speaker side of the fixture plate 44, and a second pair of microphones 54 and 56 lie on the semi-anechoic termination side of the fixture plate 44. The microphones 50, 52, 54 and 56 are located in the side of the tube 42 via penetrations. The use of microphone pairs both upstream and downstream of the sample allows the analysis to focus purely on the incident and transmitted waves into and out of the sample. The speaker 46 is directly coupled with an FFT analyzer 60, while the microphones are electrically coupled with the FFT analyzer 60 via an amplifier 58. The FFT analyzer 60 is electrically coupled with a post-processor 62.

Using the apparatus 40, measurements are conducted in the following manner. A sample 66 is placed on the fixture plate 44 within the tube 42 as shown in FIG. 15. The FFT analyzer 60 generates white noise sound waves 64 which are produced from the speaker 46. The Sound Pressure Level (SPL) generated from waves incident on the PTFE membrane sample 66 is measured from the upstream microphone pair 50 and 52. The incident pressure wave then excites the PTFE membrane sample 66 and transmits sound waves 68 downstream of the sample. The transmitted sound waves 68 are measured from the microphone pair 54 and 56. Both microphone pairs are phase matched for accurate results. The post processor 62 then measures the active Intensity Level (IL) at each 50 Hz frequency increment from 300 to 3000 Hz for microphone pair 50 and 52; and microphone pair 54 and 56. The post processor 62 also calculates the Transmission Loss (TL) using the following equation:

$$TL(\text{dB})=10\log_{10}(IL_{50,52}/IL_{54,56})$$

The overall TL is calculated using the individual TL measurements over the entire telephony frequency range (300–3000 Hz). Overall TL is calculated as follows:

$$TL_{overall}(\text{dB})=10\log_{10}(\Sigma 10^{(TL\ at\ 50\ Hz\ increments\ from\ 300\ to\ 3000\ Hz)10})$$

For example:

$$TL_{overall}(\text{dB})=10\log_{10}(10^{(TL@300\ Hz)/10}+10^{(TL@350\ Hz)/10}+10^{(TL@400\ Hz)/10}+\ldots+10^{(TL@3,000\ Hz)/10})$$

This procedure for measurement provides an accurate and simple metric for comparing material transmission loss over the frequency range for the given application. Additionally, the Transmission Loss calculation can be plotted relative to frequency in order to evaluate acoustic transmission efficiency across the spectrum.

(2) Water Entry Pressure ("WEP")

Water Entry Pressure ("WEP") provides a test method for water intrusion through membranes. WEP can be measured either as Instantaneous or Long-Term WEP. Long-term WEP is a measure of the sample's repellency or ability to serve as an aqueous barrier over time. This is an important characteristic to consider in the hydrophobic venting of electronic devices. The IP-57 standard is based on long-term WEP.

To measure instantaneous WEP, a test sample is clamped between a pair of testing plates. The lower plate has the ability to pressurize a section of the sample with water. A piece of pH paper is placed on top of the sample between the plate on the nonpressurized side as an indicator of evidence for water entry. The sample is then gradually pressurized until a color change in the pH paper indicates the first sign of water entry. The water pressure at breakthrough or entry is recorded as the instantaneous WEP.

To measure long-term WEP, the water pressure is gradually increased to 1 meter of water pressure (1.4 psig) and held for 30 minutes. After 30 minutes, if no evidence of water intrusion is observed, the sample passes the IP-57 test. If signs of water intrusion are present, the sample fails. If after 30 minutes the sample continues to hold pressure, the sample test time can be extended to determine maximum time to failure at the given water pressure.

(3) Air Permeability

The resistance of samples to air flow was measured by a Gurley densometer manufactured by W. & L. E. Gurley & Sons in accordance with the procedure described in ASTM Test Method D726-58. The results are reported in terms of Gurley Number, or Gurley-seconds, which is the time in seconds for 100 cubic centimeters of air to pass through 1 square inch of a test sample at a pressure drop of 4.88 inches of water.

(4) Particle Collection Efficiency

Particle collection efficiency may be determined by using the Model 8160 Automated Filter Tester ("AFT"), manufactured by TSI. The AFT is an automated filter that measures filter efficiency and penetration versus particle size as well as air flow resistance for air filtration media. The AFT determines the particle collection efficiency by using two condensation particle counters located both upstream and downstream of the sample under test.

The particle size for the efficiency tests of the following examples is 0.055 micrometers.

Comparative Example 1

Hydrophobic Porous Membrane with Bonded Construction

This example is a commercially available protective cover material sold under the tradename GORE ALL-WEATHER® VENT, by W. L. Gore & Associates, Inc. The product consists of a nonwoven polyester fabric (0.015" thick, 1.0 oz/yd$^2$, NEXUS® 32900005, from Precision Fabric Group Co.) bonded to a porous ePTFE membrane manufactured by W. L. Gore & Associates, Inc. The membrane bonded to the support had the following properties: mass—57.473 g/m$^2$; thickness—0.0133" (338 micrometers); air permeability—8.6 Gurley Seconds; air flow—107.76 ml/min-cm$^2$; instantaneous water entry pressure—138 psi (951.5 kPa); particle efficiency—99.999994%.

In accordance with the teachings of the '012 patent, two 30 mm diameter discs were cut, one each from the nonwoven polyester fabric and the porous PTFE membrane. The discs were aligned with and bonded together by an adhesive layer.

The first adhesive support system, 30 mm outside diameter with a removed inside diameter of 16 mm, was cut from a double-sided adhesive tape. The double-sided adhesive tape consists of a 19 micrometer thick layer of pressure sensitive acrylic adhesive on each side of 50 micrometers thick Mylar® polyester film (DFM-200-clear V-156, from Flexcon Corp.). The first adhesive support system was aligned with and bonded to the surface of the porous PTFE membrane, and the combination was attached to the nonwoven polyester fabric.

The second adhesive support system, 30 mm outside diameter with a removed inside diameter of 16 mm, was cut from a double sided adhesive tape which is described above. The second adhesive support system was aligned with and adhered to the porous PTFE membrane layer. The other surface of the second adhesive support system was centrally adhered to the fixture plate, with a centrally disposed 16 mm inside diameter, and the fixture plate assembly was located in the acoustic measurement device.

Sound Transmission Loss through the sample and long-term WEP were tested as described hereinabove. The test results are shown in Table 1.

EXAMPLE 1

Hydrophobic Porous Membrane with "Captive" Construction

An expanded PTFE membrane was provided having the following properties: mass—18.347 g/m$^2$; thickness—0.0013" (33 micrometers); air permeability—8.6 Gurley Seconds; air flow—107.71 ml/min-cm$^2$; instantaneous water entry pressure—138 psi (951.5 kPa); particle efficiency—99.999994%. A disc, 30 mm diameter, was cut from the membrane.

A second adhesive support system, 30 mm outside diameter with a removed inside diameter of 16 mm, was cut from a double-sided adhesive tape. The double-sided adhesive tape consisted of a 19 micrometer thick layer of pressure sensitive acrylic adhesive on each side of a 50 micrometer thick Mylar® polyester film (DFM-200-clear V-156, from Flexcon Corp.). The second adhesive support system was aligned with and bonded to the surface of the porous PTFE membrane.

A first adhesive support system, 30 mm outside diameter with a removed inside diameter of 16 mm, was cut from a single sided adhesive tape. The single sided adhesive tape consisted of a 19 micrometer thick layer of pressure sensitive acrylic adhesive on one side of a 50 micrometer thick Mylar® polyester film (PM-200-clear V-156, from Flexcon Corp.). The first adhesive support system was aligned with and adhered to the porous PTFE membrane surface that opposed the second adhesive support system.

The exposed adhesive of the second support system was centrally adhered to the fixture plate, with a centrally disposed 16 mm inside diameter, and the fixture plate assembly was located in the acoustic measurement device.

Sound Transmission Loss through the sample and long-term WEP were tested as described hereinabove. The test results are shown in Table 1.

Comparative Example 2

Hydrophobic Porous Black Membrane with expanded Laminate Construction

This example is a commercially available protective cover material sold under the tradename MICRO-TEX® N-Series by Nitto Denko, Inc. The product consists of a polyolefin netting which is laminated to one or both sides of a porous ePTFE membrane. The material had the following properties: mass—38.683 g/m$^2$; thickness—0.009" (228.6 micrometers); air flow—6078.4 ml/min-cm$^2$; instantaneous water entry pressure—0.4 psi (3.0 kPa); particle efficiency—NA. Particle efficiency testing was not conducted because the available sample material was smaller than the required test size. A disc, 30 mm diameter, was cut from the material described.

The disc was aligned with and bonded to a second adhesive support system and a first adhesive support system as described in Example 1 to form a sample assembly.

The exposed adhesive was centrally adhered to the fixture plate, with a centrally disposed 16 mm inside diameter, and the fixture plate assembly was located in the acoustic measurement device.

Sound Transmission Loss through the sample and long-term WEP were tested as described hereinabove. The test results are shown in Table 1.

Comparative Example 3

Hydrophobic Porous Membrane with "Captive" Construction

This example is a commercially available protective cover material sold under the tradename MICRO-TEX® Advantec 0.2 by Nitto Denko, Inc. The product consists of a porous ePTFE membrane. The material had the following properties: mass—47.5 g/m$^2$; thickness—0.0036" (91.4 micrometers); air permeability—24 .2 Gurley Seconds; air flow—38.43 ml/min-cm$^2$; instantaneous water entry pressure—120 psi (827.4 kPa); particle efficiency—99.989%. A disc, 30 mm diameter, was cut from the material described.

The disc was aligned with and bonded to a second adhesive support system and a first adhesive support system as described in Example 1 to form a sample assembly.

The exposed adhesive was centrally adhered to the fixture plate, with a centrally disposed 16 mm inside diameter, and the fixture plate assembly was located in the acoustic measurement device.

Sound Transmission Loss through the sample and long-term WEP were tested as described hereinabove. The test results are shown in Table 1.

Comparative Example 4

Hydrophobic Porous Membrane with "Captive" Construction

This example is a commercially available protective cover material sold under the tradename MICRO-TEX® NTF1033 by Nitto Denko, Inc. The product consists of a porous ePTFE membrane having a 0.2 micron pore size. The material had the following properties: mass—4.421 g/m$^2$; thickness—0.0007" (17.8 micrometers); air permeability—0. 15 Gurley Seconds; air flow—6413.81 ml/min-cm$^2$; instantaneous water entry pressure—1.8 psi (12.1 kPa); particle efficiency—74%. A disc, 30 mm diameter, was cut from the material described.

The disc was aligned with and bonded to a second adhesive support system and a first adhesive support system as described in Example 1 to form a sample assembly.

The exposed adhesive was centrally adhered to the fixture plate, with a centrally disposed 16 mm inside diameter, and the fixture plate assembly was located in the acoustic measurement device.

Sound Transmission Loss through the sample and long-term WEP were tested as described hereinabove. The test results are shown in Table 1.

EXAMPLE 2

Hydrophobic Porous Black Membrane with "Captive" Construction

The product consists of a porous expanded PTFE membrane containing 3.0% by weight of carbon black (KETJENBLACK® EC-300J, from Akzo Corp.) manufactured by W. L. Gore & Associates, Inc. The membrane had the following properties: mass—8.731 g/m$^2$; thickness—0.0012" (29.7 micrometers); air permeability—3.0 Gurley Seconds; air flow—314.72 ml/min-cm$^2$; instantaneous water entry pressure—45.6 psi (314.4 kPa); particle efficiency—99.999996%. A disc, 30 mm diameter, was cut from the material described.

The disc was aligned with and bonded to a second adhesive support system and a first adhesive support system as described in Example 1 to form a sample assembly. The exposed adhesive was centrally adhered to the fixture plate, with a centrally disposed 16 mm inside diameter, and the fixture plate assembly was located in the acoustic measurement device.

Sound Transmission Loss through the sample and long-term WEP were tested as described hereinabove. The test results are shown in Table 1.

Comparative Example 5

Oleophobic Porous Membrane with "Captive" Construction

The product consisted of a modified acrylic copolymer cast on a non-woven nylon support. The product was oleophobically treated and was manufactured by Pall Corp (VERSAPOR® 5000TR membrane). The membrane had the following properties: mass—41.4 g/m$^2$; thickness—0.0037" (94.0 micrometers); air permeability—0.8 Gurley Seconds; air flow—1207.8 ml/min-cm$^2$; instantaneous water entry pressure—7.9 psi (54.5 kPa); particle efficiency—80.4%. A disc, 30 mm diameter, was cut from the material described.

The disc was aligned with and bonded to a second adhesive support system and a first adhesive support system as described in Example 1 to form a sample assembly.

The exposed adhesive was centrally adhered to the fixture plate, with a centrally disposed 16 mm inside diameter, and the fixture plate assembly was located in the acoustic measurement device.

Sound Transmission Loss through the sample and long-term WEP were tested as described hereinabove. The test results are shown in Table 1.

Comparative Example 6

Oleophobic Porous Membrane with "Captive" Construction

The product consisted of a polyvinylidene flouride (PVDF) membrane with oleophobic treatment and a 0.22 micron pore size and was manufactured by Millipore Corporation (DURAPEL® 0.22 micron membrane). The membrane had the following properties: mass—67.4 g/m$^2$; thickness—0.0044 (111.3 micrometers); air permeability—41.8 Gurley Seconds; air flow—22.25 ml/min-cm$^2$; instantaneous water entry pressure—>50 psi (>345.0 kPa). Particle efficiency and a discrete water entry pressure level were not measured. However, referring to a Millipore brochure, the water entry pressure for the subject membrane is expected to be 62 psi (427.5 kPa). Particle efficiency testing was not conducted because the available sample material was smaller than the required test size. A disc, 30 mm diameter, was cut from the material described.

The disc was aligned with and bonded to a second adhesive support system and a first adhesive support system as described in Example 1 to form a sample assembly.

The exposed adhesive was centrally adhered to the fixture plate, with a centrally disposed 16 mm inside diameter, and the fixture plate assembly was located in the acoustic measurement device.

Sound Transmission Loss through the sample and long-term WEP were tested as described hereinabove. The test results are shown in Table 1.

EXAMPLE 3

Oleophobic Porous Membrane with "Captive" Construction

The product consisted of a porous ePTFE membrane with oleophobic treatment in accordance with U. S. Pat. No. 5,376,441, manufactured by W. L. Gore & Associates, Inc. The membrane had the following properties: mass—12.1 g/m$^2$; thickness—0.0009" (22.1 micrometers); air permeability—2.6 Gurley Seconds; air flow—362.10 ml/min-cm$^2$; instantaneous water entry pressure—73.7 psi (508.1 kPa); particle efficiency—99.999996%. A disc, 30 mm diameter, was cut from the material described.

The disc was aligned with and bonded to a second adhesive support system and a first adhesive support system as described in Example 1 to form a sample assembly.

The exposed adhesive was centrally adhered to the fixture plate, with a centrally disposed 16 mm inside diameter, and the fixture plate assembly was located in the acoustic measurement device.

Sound Transmission Loss through the sample and long-term WEP were tested as described hereinabove. The test results are shown in Table 1.

TABLE 1

| Examples | TL (dB) | WEP inst (psi) | LT WEP (hr) | Mass (g/m$^2$) | Thickness (mils) | Thickness ($\mu$m) | Gurley (sec) | Air Flow (ml/min-cm$^2$) | Particle Efficiency (%) |
|---|---|---|---|---|---|---|---|---|---|
| Comparative 1 | 6.6 | 138 | >4 | 57.473 | 13.30 | 337.82 | 8.63 | 107.76 | 99.999994 |
| Example 1 | 2.6 | 138 | >4 | 18.347 | 1.30 | 33.02 | 8.63 | 107.71 | 99.999994 |
| Comparative 2 | 5.5 | 0.43 | <0.5 | 38.683 | 9.00 | 228.60 | 0.15 | 6078.44 | NA |
| Comparative 3 | 5.9 | 120 | >4 | 47.525 | 3.60 | 91.44 | 24.20 | 38.43 | 99.989 |
| Comparative 4 | 1.7 | 1.75 | <0.5 | 4.421 | 0.70 | 17.78 | 0.15 | 6413.81 | 74 |
| Example 2 | 2.2 | 45.6 | >4 | 8.7314 | 1.17 | 29.72 | 2.96 | 314.72 | 99.999996 |
| Comparative 5 | 5.1 | 7.9 | <0.5 | 41.447 | 3.70 | 93.98 | 0.77 | 1207.79 | 80.39 |
| Comparative 6 | 7.0 | >50 | >4 | 67.42 | 4.38 | 111.25 | 41.80 | 22.25 | NA |
| Example 3 | 2.0 | 73.7 | >4 | 12.102 | 0.87 | 22.10 | 2.57 | 362.10 | 99.999996 |

What is claimed is:

1. A sound-transmissive protective cover assembly, consisting essentially of:

(a) at least one microporous membrane having an inner unbonded region and a periphery bonded region; and (b) at least one adhesive support system, said at least one membrane being bonded around its periphery to said at least one adhesive support system such that at least a portion of said inner unbonded region of the membrane is exposed to the atmosphere and free to move in response to acoustic energy, said assembly having an instantaneous water entry pressure of at least one meter water column and an overall acoustic transmission loss of no more than 3 dB in the range of frequencies from 300 to 3000 Hz, wherein the assembly further comprises an acoustic gasket; and wherein the acoustic gasket is bonded to and coextensive with the at least one adhesive support system so as to not impede independent movement of the membrane in the unbonded region.

2. The sound-transmissive cover assembly of claim 1, wherein the assembly further comprises a black color.

3. The sound-transmissive cover assembly of claim 1, wherein the assembly further comprises an oleophobic treatment.

4. The sound-transmissive cover assembly of claim 1, wherein said adhesive support system further comprises at least one supplemental bonding site extending across a portion of said inner unbonded region.

5. A sound-transmissive protective cover assembly, consisting essentially of:

(a) at least one microporous membrane having an inner unbonded region and a periphery bonded region; and (b) a plurality of adhesive support systems, said at least one membrane being bonded around its periphery to said plurality of adhesive support systems such that at least a portion of said inner unbonded region of the membrane is exposed to the atmosphere and free to move in response to acoustic energy, said assembly having an instantaneous water entry pressure of at least one meter water column and an overall acoustic transmission loss of no more than 3 dB in the range of frequencies from 300 to 3000 Hz,, wherein said microporous membrane is supported by said adhesive support systems in a captive construction.

6. The sound-transmissive cover assembly of claim 5, wherein said cover assembly further comprises an acoustic gasket.

7. A method of using a microporous membrane as a sound-transmissive acoustic protective cover for an electronic device having a transducer, comprising:

providing an assembly consisting essentially of a microporous membrane having first and second surfaces and a perimeter defined by its edges, at least one of said surfaces bonded to at least one adhesive support system to form a periphery bonded region surrounding an inner unbonded region of the microporous membrane such that said first and second surfaces of the inner unbonded region of said membrane are exposed to the atmosphere and free to move in response to acoustic energy; and orienting said supported microporous membrane so as to cover the transducer in the electronic device, thereby forming a sound-transmissive acoustic protective cover;

whereby the cover has an instantaneous water entry pressure of at least one meter water column and an overall acoustic transmission loss of no more than 3 dB in the range of frequencies from 300 to 3000 Hz.

8. The method claim 7, further comprising providing an oleophobic treatment on said microporous membrane.

9. A sound-transmissive cover assembly consisting essentially of:

a microporous membrane layer having first and second surfaces and a perimeter defined by its edges, at least one of said surfaces bonded to a support system to form a periphery bonded region surrounding an inner unbonded region of the microporous membrane, whereby said first and second surfaces of said inner unbonded region are exposed to the atmosphere and free to move in response to acoustic energy, said assembly having an instantaneous water entry pressure of at least one meter water column and an overall acoustic transmission loss of no more than 3 dB in the range of frequencies from 300 to 3000 Hz.

10. The sound-transmissive cover assembly of claim 9, wherein said support system comprises at least one adhesive ring.

11. The sound-transmissive cover assembly of claim 9, wherein said support system comprises a plastic encapsulation.

12. The sound-transmissive cover assembly of claim 9, further comprising means for bonding the assembly to an acoustic device.

13. The sound-transmissive cover assembly of claim 9, wherein the assembly further comprises a black color.

14. The sound-transmissive cover assembly of claim 9, wherein the assembly further comprises an oleophobic treatment.

15. The sound-transmissive cover assembly of claim 9, wherein the assembly further comprises an acoustic gasket;

wherein the acoustic gasket is bonded to and coextensive with the at least one adhesive support system so as to not impede independent movement of the membrane in the inner unbonded region.

16. The sound-transmissive cover assembly of claim 9, wherein the at least one membrane is ePTFE.

* * * * *

US006512834C1

(12) EX PARTE REEXAMINATION CERTIFICATE (9187th)

United States Patent

Banter et al.

(10) Number: US 6,512,834 C1

(45) Certificate Issued: Aug. 14, 2012

(54) ACOUSTIC PROTECTIVE COVER ASSEMBLY

(75) Inventors: Chad Anthony Banter, Bear, DE (US); Brian G. Chapman, Elkton, MD (US)

(73) Assignee: Gore Enterprise Holdings, Inc., Newark, DE (US)

Reexamination Request:
No. 90/011,578, Apr. 22, 2011

Reexamination Certificate for:

| | |
|---|---|
| Patent No.: | **6,512,834** |
| Issued: | **Jan. 28, 2003** |
| Appl. No.: | **09/348,416** |
| Filed: | **Jul. 7, 1999** |

(51) Int. Cl.
*H04R 1/08* (2006.01)
*H04R 1/00* (2006.01)

(52) U.S. Cl. ..... 381/386; 379/439; 379/452; 181/175; 381/189; 381/FOR. 151; 381/FOR. 140; 381/FOR. 165

(58) Field of Classification Search ..... None
See application file for complete search history.

(56) References Cited

To view the complete listing of prior art documents cited during the proceeding for Reexamination Control Number 90/011,578, please refer to the USPTO's public Patent Application Information Retrieval (PAIR) system under the Display References tab.

*Primary Examiner*—Michelle Tarae

(57) ABSTRACT

A sound-transmissive cover assembly is disclosed which provides protection from the ambient environment to transducer devices, such as microphones, loudspeakers, buzzers, ringers and the like. The cover assembly has a microporous protective membrane that is captivated at the outer region near the edges between two adhesive support systems. An inner unbonded region surrounded by the bonded outer region is provided so that the protective membrane can displace or move in response to acoustic pressure waves. The protective membrane design in conjuction with the configuration allows sound energy to pass through the protective membrane with very low attenuation, while being able to withstand long-term exposure to liquid intrusion. An embodiment of the cover assembly includes an attached acoustic gasket so as to seal and focus acoustic energy to housing apertures or openings.

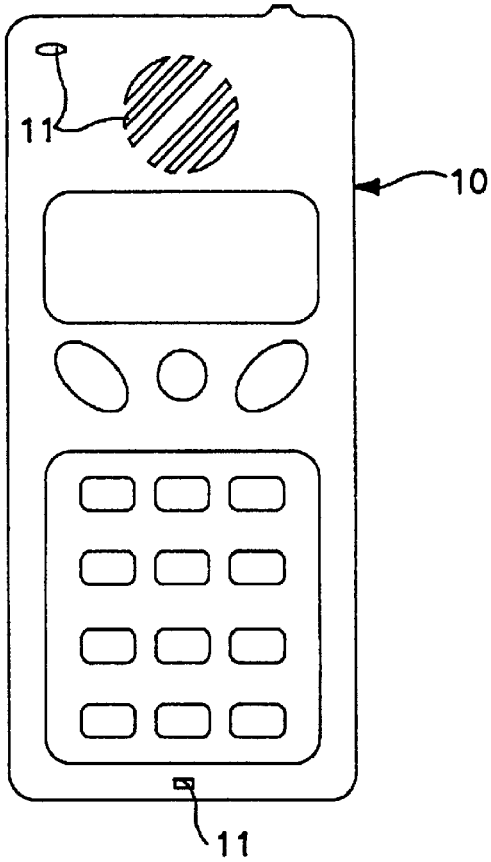

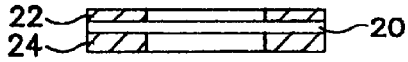

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 5, 7 and 9 are determined to be patentable as amended.

Claims 2-4, 6, 8 and 10-16, dependent on an amended claim, are determined to be patentable.

New claims 17-44 are added and determined to be patentable.

1. A sound-transmissive protective cover assembly, consisting essentially of:

(a) at least one microporous membrane *defining a first face and a second face opposite the first face and* having an inner unbonded region and a periphery bonded region; and (b) at least one adhesive support system, said at least one membrane being bonded around its periphery to said at least one adhesive support system such that at least a portion of said inner unbonded region of the membrane is *left uncovered and* exposed to the atmosphere *at the first and second faces* and free to move in response to acoustic energy,said assembly having an instantaneous water entry pressure of at least one meter water column and an overall acoustic transmission loss of no more than 3 dB in the range of frequencies from 300 to 3000 Hz, wherein the assembly further comprises an acoustic gasket; and wherein the acoustic gasket is bonded to and coextensive with the at least one adhesive support system so as to not impede independent movement of the membrane in the unbonded region.

5. A sound-transmissive protective cover assembly, consisting essentially of:

(a) at least one microporous membrane *defining a first face and a second face opposite the first face and* having an inner unbonded region and a periphery bonded region; and (b) a plurality of adhesive support system, said at least one membrane being bonded around its periphery to said plurality of adhesive support systems such that at least a portion of said inner unbonded region of the membrane is *left uncovered and* exposed to the atmosphere *at the first and second faces* and free to move in response to acoustic energy, said assembly having an instantaneous water entry pressure of at least one meter water column and an overall acoustic transmission loss of no more than 3 dB in the range of frequencies from 300 to 3000 Hz, wherein said microporous membrane is supported by said adhesive support systems in a captive construction.

7. A method of using a microporous membrane as a sound-transmissive acoustic protective cover for an electronic device having a transducer, comprising:

providing an assembly consisting essentially of a microporous membrane having first and second surfaces and a perimeter defined by its edges, at least one of said surfaces bonded to at least one adhesive support system to form a periphery bonded region surrounding an inner unbonded region of the microporous membrane *leaving the first and second surfaces at least partially uncovered* such that said first and second surfaces of the inner unbonded region of said membrane are exposed to the atmosphere and free to move in response to acoustic energy; and orienting said supported microporous membrane so as to cover the transducer in the electronic device, thereby forming a sound-transmissive acoustic protective cover; whereby the cover has an instantaneous water entry pressure of at least one meter water column and an overall acoustic transmission loss of no more than 3 dB in the range of frequencies from 300 to 3000 Hz.

9. A sound-transmissive cover assembly consisting essentially of a microporous membrane layer having first and second surfaces and a perimeter defined by its edges, at least one of said surfaces bonded to a support system to form a periphery bonded region surrounding an inner unbonded region of the microporous membrane, whereby said first and second surfaces of said inner unbonded region are *at least partially uncovered and* exposed to the atmosphere and free to move in response to acoustic energy, said assembly having an instantaneous water entry pressure of at least one meter water column and an overall acoustic transmission loss of no more than 3 dB in the range of frequencies from 300 to 3000 Hz.

*17. The sound-transmissive cover assembly of claim 1, wherein the adhesive support system consists essentially of adhesive and a substrate.*

*18. The sound-transmissive cover assembly of claim 1, wherein the adhesive support system comprises a substrate carrying an adhesive, the adhesive bonding the substrate to the microporous membrane.*

*19. The sound-transmissive cover assembly of claim 1, wherein the at least one adhesive support system includes a first adhesive support system and a second adhesive support system, the first and second adhesive support systems forming the captive construction with the at least one microporous membrane, each of the first and second adhesive support systems consisting essentially of adhesive and a substrate.*

*20. The sound-transmissive assembly of claim 1, wherein the at least one adhesive support system has a thickness of about 90 micrometers.*

*21. The sound-transmissive assembly of claim 1, wherein the mass of the at least one microporous membrane is from 1 to 40 grams/m$^2$.*

*22. The sound-transmissive assembly of claim 1, wherein the at least one microporous membrane has a thickness from 3 to 150 micrometers.*

*23. The sound-transmissive assembly of claim 1, wherein the at least one microporous membrane is substantially flat.*

*24. The sound-transmissive assembly of claim 1, wherein the at least one microporous membrane defines a first, substantially flat face and a second, substantially flat face opposite the first substantially flat face.*

*25. The sound-transmissive assembly of claim 1, wherein the at least one microporous membrane has a first face and a second face opposite the first face, the at least one adhesive support system having an adhered face bonded to a portion of the first face of the at least one microporous membrane and an exposed face opposite the adhered face, the at least*

*one adhesive support system defining a thickness between the adhered face and the exposed face, the thickness of the at least one adhesive support system being such that the first face of the at least one microporous membrane does not project beyond the thickness of the at least one adhesive support system.*

*26. The sound-transmissive assembly of claim 1, wherein the at least one microporous membrane has a water entry pressure resistance from 5 to 200 psi.*

*27. The sound-transmissive assembly of claim 1, wherein the at least one microporous membrane has a water entry pressure resistance from 20 to 150 psi.*

*28. The sound-transmissive assembly of claim 1, configured to meet IP-57 level water protection.*

*29. The sound-transmissive assembly of claim 1, wherein the adhesive support system includes an adhesive and a support layer, and further wherein the support layer does not fully cover the inner unbonded region of the membrane.*

*30. The sound-transmissive assembly of claim 1, wherein the adhesive support system consists essentially of a support layer and adhesive, and further wherein the support layer covers the periphery of the membrane and includes an opening leaving at least a portion of the inner unbonded region of the membrane uncovered by the support layer.*

*31. The sound-transmissive assembly of claim 1, wherein the adhesive support system includes a support layer and adhesive, and further wherein the support layer and the adhesive cover the periphery of the membrane, the support layer having an opening and the adhesive having an opening such that a portion of the inner unbonded region of the membrane is left uncovered by the support layer and the adhesive.*

*32. The sound-transmissive assembly of claim 1, wherein the adhesive support system includes a support layer and adhesive, and further wherein the support layer and the adhesive are substantially coextensive.*

*33. The sound-transmissive assembly of claim 5, wherein each of the plurality of adhesive support systems includes an adhesive and a support layer, and further wherein the support layer does not fully cover the inner unbonded region of the membrane.*

*34. The sound-transmissive assembly of claim 5, wherein each of the plurality of adhesive support systems consists essentially of a support layer and adhesive, and further wherein the support layer covers the periphery of the membrane and includes an opening leaving at least a portion of the inner unbonded region of the membrane uncovered by the support layer.*

*35. The sound-transmissive assembly of claim 5, wherein each of the plurality adhesive support systems includes a support layer and adhesive, and further wherein the support layer and the adhesive cover the periphery of the membrane, the support layer having an opening and the adhesive having an opening such that a portion of the inner unbonded region of the membrane is left uncovered by the support layer and the adhesive.*

*36. The sound-transmissive assembly of claim 5, wherein each of the plurality of adhesive support systems includes a support layer and adhesive, and further wherein the support layer and the adhesive are substantially coextensive.*

*37. The method of claim 7, wherein the adhesive support system of the assembly being provided includes an adhesive and a support layer, and further wherein the support layer does not fully cover the inner unbonded region of the membrane.*

*38. The method of claim 7, wherein the adhesive support system of the assembly being provided consists essentially of a support layer and adhesive, and further wherein the support layer covers the periphery of the membrane and includes an opening leaving at least a portion of the inner unbonded region of the membrane uncovered by the support layer.*

*39. The method of claim 7, wherein the adhesive support system of the assembly being provided includes a support layer and adhesive, and further wherein the support layer and the adhesive cover the periphery of the membrane, the support layer having an opening and the adhesive having an opening such that a portion of the inner unbonded region of the membrane is left uncovered by the support layer and the adhesive.*

*40. The method of claim 7, wherein the adhesive support system of the assembly being provided includes a support layer and adhesive, and further wherein the support layer and the adhesive are substantially coextensive.*

*41. The sound-transmissive assembly of claim 9, wherein the adhesive support system includes an adhesive and a support layer, and further wherein the support layer does not fully cover the inner unbonded region of the membrane.*

*42. The sound-transmissive assembly of claim 9, wherein the adhesive support system consists essentially of a support layer and adhesive, and further wherein the support layer covers the periphery of the membrane and includes an opening leaving at least a portion of the inner unbonded region of the membrane uncovered by the support layer.*

*43. The sound-transmissive assembly of claim 9, wherein the adhesive support system includes a support layer and adhesive, and further wherein the support layer and the adhesive cover the periphery of the membrane, the support layer having an opening and the adhesive having an opening such that a portion of the inner unbonded region of the membrane is left uncovered by the support layer and the adhesive.*

*44. The sound-transmissive assembly of claim 9, wherein the adhesive support system includes a support layer and adhesive, and further wherein the support layer and the adhesive are substantially coextensive.*

* * * * *